US012403999B2

(12) United States Patent
Orvieto et al.

(10) Patent No.: US 12,403,999 B2
(45) Date of Patent: Sep. 2, 2025

(54) MARINE PROPULSION SYSTEM SUPPORTED BY A STRUT

(71) Applicants: ZF FRIEDRICHSHAFEN AG, Friedrichshafen (DE); ZF MARINE PROPULSION SYSTEMS MIRAMAR, LLC, Miramar, FL (US)

(72) Inventors: Andrew Orvieto, Plantation, FL (US); Keith Stanley, Coral Springs, FL (US); Dave Gruenwald, Oshkosh, WI (US); Bryan Danner, Oshkosh, WI (US)

(73) Assignees: ZF Friedrichshafen AG, Friedrichshafen (DE); ZF MARINE PROPULSION SYSTEMS MIRAMAR, LLC, Miramar, FL (US)

( * ) Notice: Subject to any disclaimer, the term of this patent is extended or adjusted under 35 U.S.C. 154(b) by 854 days.

(21) Appl. No.: 17/685,550

(22) Filed: Mar. 3, 2022

(65) Prior Publication Data

US 2023/0278690 A1 Sep. 7, 2023

(51) Int. Cl.

| | |
|---|---|
| ***B63H 23/06*** | (2006.01) |
| ***B63H 23/34*** | (2006.01) |
| ***B63H 25/38*** | (2006.01) |
| *B63H 23/02* | (2006.01) |

(52) U.S. Cl.

CPC ..... *B63H 23/06* (2013.01); *B63H 23/34* (2013.01); *B63H 25/38* (2013.01); *B63H 2023/0283* (2013.01); *B63H 2023/067* (2013.01)

(58) Field of Classification Search

CPC ..... B63H 23/06; B63H 23/34; B63H 25/38

See application file for complete search history.

(56) References Cited

U.S. PATENT DOCUMENTS

| | | | | |
|---|---|---|---|---|
| 5,017,168 | A * | 5/1991 | Ackley | B63H 5/10 416/129 |
| 10,906,618 | B2 * | 2/2021 | Stanley | B63H 23/34 |
| 2008/0089786 | A1 * | 4/2008 | Sinreich | B63H 5/10 416/129 |
| 2020/0070944 | A1 * | 3/2020 | Stolper | B63H 23/321 |

FOREIGN PATENT DOCUMENTS

WO 2018/106288 A1 6/2018

* cited by examiner

*Primary Examiner* — S. Joseph Morano
*Assistant Examiner* — Jovon E Hayes
(74) *Attorney, Agent, or Firm* — Finch & Maloney PLLC

(57) ABSTRACT

A marine propulsion system, supported by a strut, which comprises an inner propeller shaft supporting a first propeller adjacent a trailing end thereof, and the inner propeller shaft is connected to the drive shaft for receiving and supplying a first portion of torque to the first propeller as well as transfer thrust, generated by the first propeller, along the inner propeller shaft back to the drive shaft. An outer propeller shaft supports a second propeller adjacent a trailing end thereof, and the outer propeller shaft surrounds the inner propeller shaft. A planetary gear assembly receives a second portion of the torque and supplies the torque to the outer propeller shaft so that the second propeller rotates in an opposite direction to the first propeller. A portion of the planetary gear assembly is accommodated vertically above a flat end face of the strut for reducing hydrodynamic drag of the strut.

20 Claims, 4 Drawing Sheets

FIG. 5
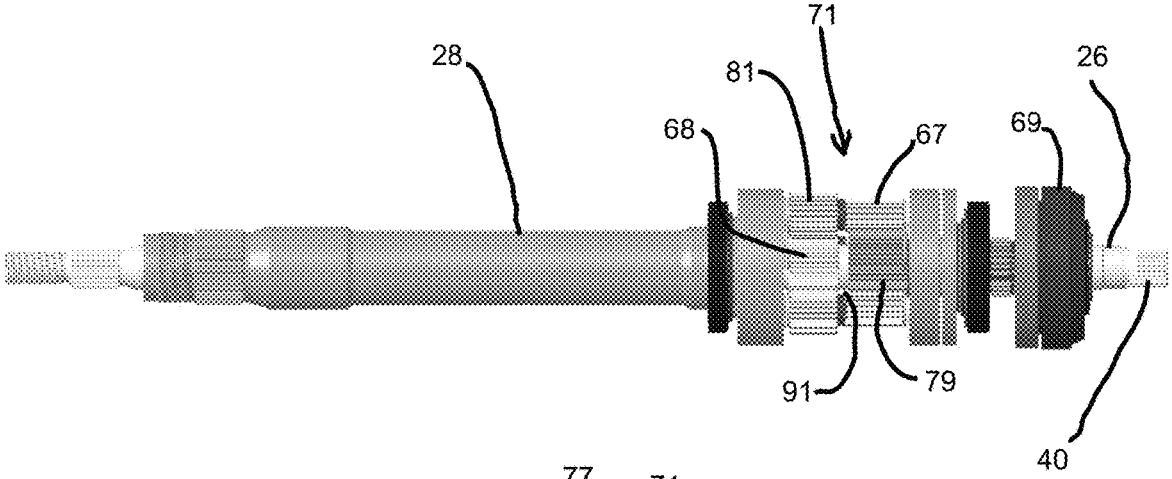
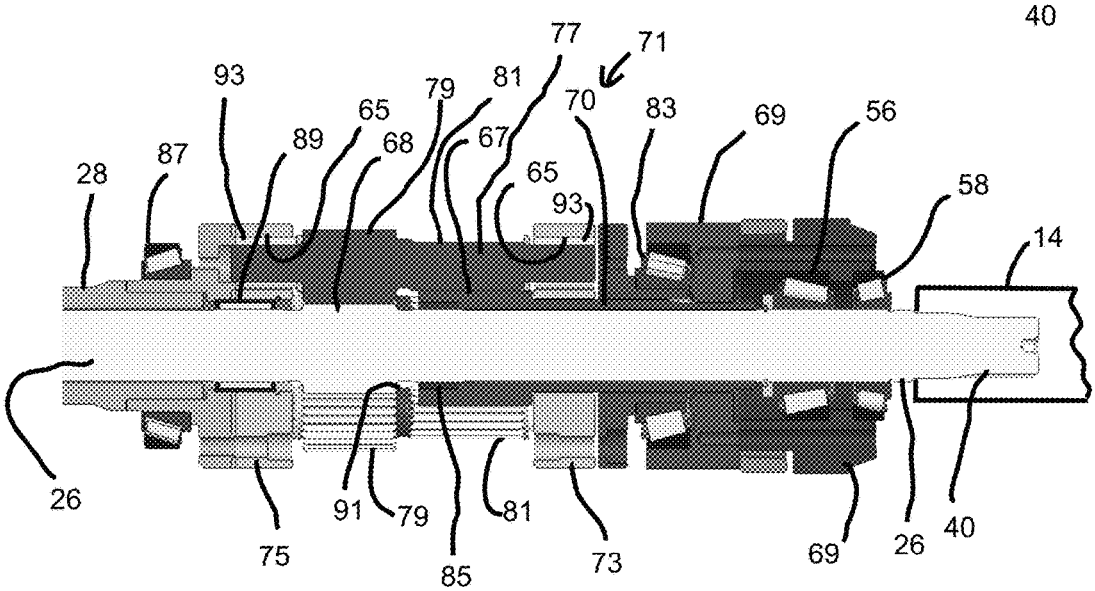
FIG. 6

MARINE PROPULSION SYSTEM SUPPORTED BY A STRUT

FIELD OF THE INVENTION

The present disclosure relates generally to a marine propulsion system and, in particular, to a marine propulsion system comprising a planetary gear assembly mounted in the strut to facilitate driving a second propeller in an opposite rotational direction than the first propeller. The thrust, generated by the first and second counter rotating propellers, is transferred back along the inner and outer propeller shafts to the flat end face and the mounting plate of the strut for distribution to the vessel. In addition, the marine propulsion system includes a closed lubrication system, for lubricating the rotatable components thereof, and a shimming system for altering the orientation/position of the strut and the inner and the outer propeller shafts, relative to the drive shaft, to compensate for any misalignment therebetween.

BACKGROUND OF THE INVENTION

Counter rotating propellers are highly desirable for a number of marine applications. Normally counter rotating propellers are utilized for outdrives, pod systems and outboard motors. Dual propellers, that are counter-rotating, provide a much improved level of thrust efficiency, as well as allowing the thrust path to be straight when moving forward or astern. In addition, the dual propellers remove a paddle wheel effect of a single propeller that typically forces the stern of the vessel in the direction of rotation of the propeller, also known as side thrust.

What is lacking in the prior art is a strut mounted propulsion system having counter rotating propellers in which the thrust, generated by the counter rotating propellers, is transferred from the propellers back along the propeller shafts and the drive shaft back to the flat end face and the mounting plate of the strut for dissipation and distribution while providing a very hydrodynamic profile.

In addition, the prior art strut mounted propulsion arrangements have a relatively large footprint which, in turn, increases the hydrodynamic drag generated by the marine propulsion system as the marine propulsion system travels through water.

SUMMARY OF THE INVENTION

Wherefore, it is an object of the present disclosure to overcome the above mentioned shortcomings and drawbacks associated with the prior art marine propulsion systems.

Another object of the present disclosure is to minimize the overall size and/or footprint of the marine propulsion drive, including the associate housing, which is located within the water, during use, so as to reduce the amount of hydrodynamic drag generated as the marine propulsion system travels through water.

A further object of the present disclosure is to provide a marine propulsion system, with a pair of counter rotating propellers, in which the torque is supplied by the drive shaft and the inner and outer propeller shafts to the first and second counter rotating propellers, and the thrust, generated by the first and second counter rotating propellers, is conveyed back along the inner and the outer propeller shafts and the drive shaft to the flat end face and the mounting plate of the strut for dissipation and distribution to the vessel.

A still further object of the present disclosure is to design a marine propulsion system which has lower assembly costs due to the utilization of simple helical gears instead of more expensive spiral bevel gearings.

Yet another object of the present disclosure is to design a marine propulsion system which has an integrated water pickup and an integrated drive shaft seal so as to save assembly time and thereby reduce the overall manufacturing costs of the marine propulsion drive.

A further object of the present disclosure is to accommodate the larger components of the marine drive assembly, as least partially, within the vessel so that primarily only the inner and the outer propeller shafts are accommodated within and surrounded by the strut, which is mounted to the bottom of the vessel, thereby decreasing the overall size and/or footprint of the strut and also decreasing the hydrodynamic drag of the strut when traveling through water.

Another object of the present disclosure is to design a marine propulsion system in which alignment of the drive shaft with the inner and the outer propeller shafts becomes less critical thereby making installation of the marine propulsion system much easier, faster and less expensive.

Still another object of the present disclosure is to design a marine propulsion system which requires only simple machining and requires sealing of only a single open or aperture in the bottom of the vessel thereby reducing the associated time and effort during installation of the marine propulsion system.

Yet another object of the present disclosure is to provide one or more contoured spacer insert(s)/shim(s) for either spacing the strut a desired distance away from an outwardly facing bottom surface of the hull or altering the orientation/position of the inner and the outer propeller shafts and the strut, relative to either the outwardly facing bottom surface of the hull or the drive shaft, e.g., to tilt the strut forward or rearward, or toward the right or the left, or both, and thereby assist with precisely aligning the drive shaft with the inner and outer propeller shafts so that the generated thrust, from the first and second counter rotating propellers, is directed and conveyed along the inner and outer propeller shafts and the drive shaft toward the transmission and the engine for distribution and dissipation to a remainder of the vessel.

A still further object of the present disclosure is to form a lubricate chamber, within the marine propulsion system, which is sealed and isolated from the external environment by a plurality of watertight rotatable seals so that all of the rotatable components, e.g., the planetary gear assembly, the needle bearings, the tapered bearings, the thrust bearings, the inner propeller shaft, the outer propeller shaft, etc., of the marine propulsion system are adequately lubricated during operation.

The present disclosure relates to a marine propulsion system, supported by a strut, comprising: an inner propeller shaft supporting a first propeller adjacent a trailing end thereof, and the inner propeller shaft having an interface, at a leading end thereof, to facilitate connection with a drive shaft for receiving torque therefrom and supplying a first portion of the torque to the first propeller; an outer propeller shaft supporting a second propeller, adjacent a trailing end thereof, and the outer propeller shaft surrounding the inner propeller shaft; the strut having a strut through bore for accommodating and surrounding the inner and the outer propeller shafts; and a planetary gear assembly for receiving a second portion of the torque from the drive shaft and supplying the second portion of torque to the outer propeller shaft so that the second propeller rotates in an opposite rotational direction than the first propeller; wherein at least a portion of the planetary gear assembly is accommodated vertically above a flat end face of the strut for reducing hydrodynamic drag generated by the strut as the marine propulsion system travels through water.

The present disclosure also relates to a method of using a marine propulsion system to power a vessel, the method comprising: supporting a first propeller adjacent a trailing end of an inner propeller shaft; providing an interface at a leading end of the inner propeller shaft to facilitate connection with a drive shaft for receiving torque therefrom and supplying a first portion of the torque to the first propeller; supporting a second propeller adjacent a trailing of an outer propeller shaft, and the outer propeller shaft surrounding the inner propeller shaft; providing a strut through bore for accommodating and surrounding the inner and the outer propeller shafts; and providing a planetary gear assembly for receiving a second portion of the torque from the drive shaft and supplying the second portion of torque to the outer propeller shaft so that the second propeller rotates in an opposite rotational direction to the first propeller; and accommodating at least a portion of the planetary gear assembly vertically above a flat end face of the strut so as to reduce hydrodynamic drag, generated by the strut, as the marine propulsion system travels through water.

BRIEF DESCRIPTION OF THE DRAWINGS

The accompanying drawings, which are incorporated in and constitute a part of the specification, illustrate an embodiment of the disclosure and together with the general description of the disclosure given above and the detailed description of the drawings and the invention given below, serve to explain the principles of the disclosure. The disclosure will now be described, by way of example, with reference to the accompanying drawings in which:

FIG. 5 is a diagrammatic side elevational view of the marine propulsion drive of FIG. 3, with a few of the exterior components removed to show more clearly components of the planetary gear assembly according to the disclosure;

FIG. 6 is an enlarged diagrammatic cross sectional view of the planetary gear assembly shown in FIG. 5;

Figure 1:
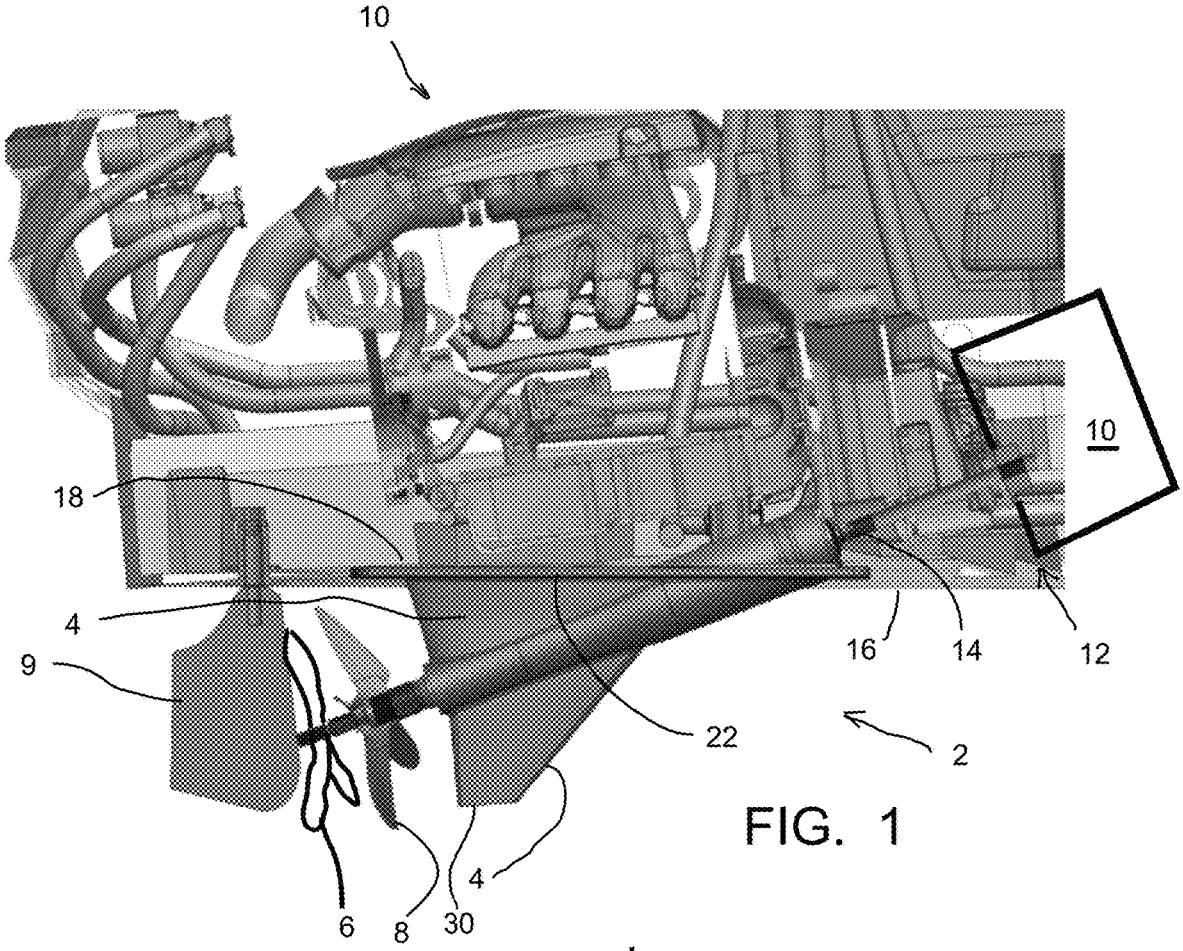
FIG. 1 is a diagrammatic cross sectional view showing the marine propulsion system following installation on a vessel.

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiment(s) illustrated herein.

DETAILED DESCRIPTION OF THE PREFERRED EMBODIMENTS

The present disclosure will be understood by reference to the following detailed description, which should be read in conjunction with the appended drawings. It is to be appreciated that the following detailed description of one embodiment is by way of example only and is not meant to limit, in any way, the scope of the present disclosure.

In the drawings, the terms "leading end" and "upstream" means the end or portion closest to the engine where the torque is generated, while the terms "trailing end" and "downstream" means the end or portion closest to the propellers. Also in the drawings, the terms "lower" and "bottom" refer toward the bottom edge of the drawings while the terms "upper" and "top" refer toward the top edge of the drawings.

Turning now to FIGS. 1-4 and 7, a brief description concerning the various components of the present disclosure will now be briefly discussed. As can be seen in those figures, the present disclosure relates to a marine propulsion system 2 which is supported by a strut 4 and has first and second counter rotating propellers 6, 8.

As is diagrammatically shown in FIG. 1, the marine propulsion system 2 is driven or powered by a conventional engine 10, such as an internal combustion (e.g., a gas or a diesel) engine (only diagrammatically shown). The output from the crankshaft of the engine 10 is typically coupled to a reducing transmission 12 (only diagrammatically shown) while the output from the reducing transmission 12 drives a leading end of a drive shaft 14 which forms the drive input to the marine propulsion system 2. A rudder 9 is installed, downstream of the first and second counter rotating propellers 6, 8, to facilitate steering of the vessel by an operator in a conventional manner.

The strut 4 is fixedly secured, in a conventional manner, to a bottom surface of the hull 16 of the vessel by a mounting plate 18 (see FIG. 2) and a plurality of conventional fasteners, e.g., a plurality of bolts which are not shown in detail. Following installation of the strut 4, the mounting plate 18 is located within the vessel and abuts against an inwardly facing bottom surface of the hull 16 of the vessel while a generally flat end face 22 of the strut 4 abuts against an outwardly facing bottom surface of the hull 16. The plurality of fasteners are each received by a respective mating threaded bore (not shown in detail), formed within the flat end face 22 of the strut 4, to assist with securely fastening the strut 4 to the bottom surface of the hull 16. It is to be appreciated that other conventional mounting arrangements are also possible without departing from the spirit and scope of the present disclosure. Typically, at least a perimeter region of an opening formed in the bottom surface of the hull 16 is directly sandwiched between the mounting plate 18 and the flat end face 22 of the strut 4 in a conventional water tight manner to form a seal between those components.

If desired or required, one or more contoured spacer insert(s)/shim(s) may be located between the outwardly facing bottom surface of the hull 16 and the flat end face 22 of the strut 4. That is, the one or more contoured spacer insert(s)/shim(s) may be used to either space the flat end face 22 of the strut 4 a desired distance away from the outwardly facing bottom surface of the hull 16 in order to alter or change the orientation/position of the strut 4, relative to either the outwardly facing bottom surface of the hull 16 or the drive shaft 14, for example, e.g., to tilt the strut 4 a little more forward or to tilt the strut 4 a little more rearward or possibly to tilt the strut 4 either toward the right or the left side of the vessel. Each one of the contoured spacer insert(s)/shim(s) is provided with either a central opening or a respective through bore for allowing each one of the fasteners to pass therethrough and still engage with the strut 4. By installation of one or more suitably shaped and sized contoured spacer insert(s)/shim(s), between the outwardly facing bottom surface of the hull 16 and the mating flat end face 22 of the strut 4, the orientation/position of the strut 4 and the inner and outer shafts 26, 28, relative to the drive shaft 14 and/or the bottom surface of the hull 16, can be easily altered during installation.

If desired, a skeg 30 may be formed on the strut 4, opposite the flat end face 22, to form a bottom or lower most portion of the strut 4.

Figure 3:
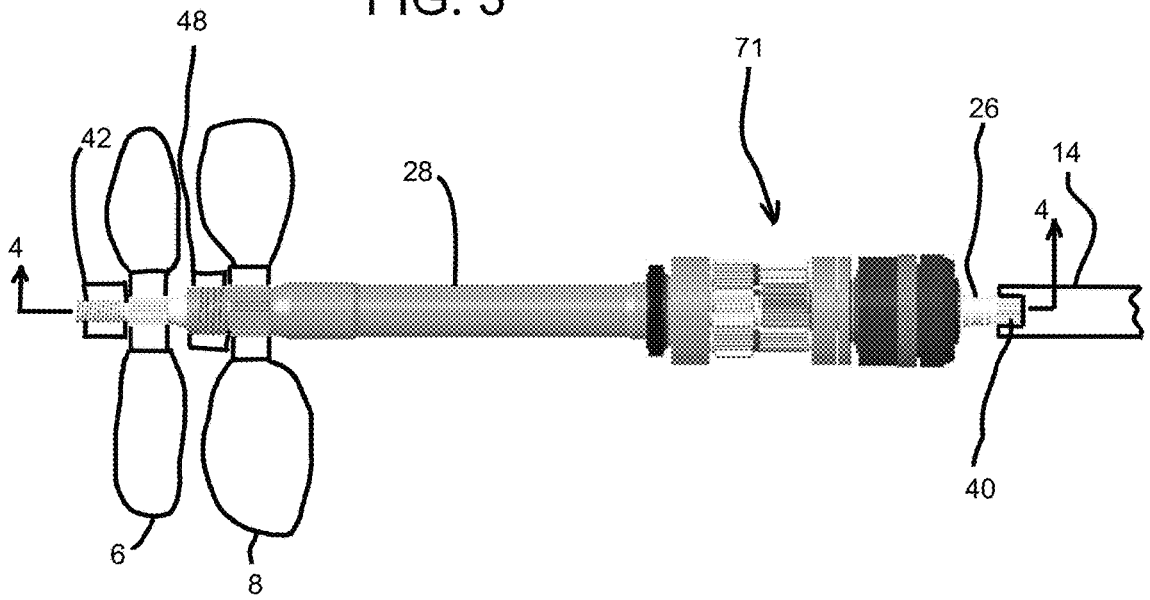
FIG. 3 is a diagrammatic side elevational view of the marine propulsion drive, prior to installation of the marine propulsion drive within a through bore of the strut so as to form the marine propulsion system according to the disclosure.

As diagrammatically shown in FIGS. 3 and 6 of the drawings, the trailing end of the drive shaft 14 is provided with an internal spline while the leading end of the inner propeller shaft 26 has an outwardly facing spline. The external spline of the drive shaft 14 matingly engages with the internal spline of the inner propeller shaft 26 to form a coupling feature, an interface or a spline connection 40 which pivotably couples those two shafts 14, 26 with one another. The spline connection 40 permits the drive shaft 14 to pivot, over a relatively small range of movement, with respect to the inner propeller shaft 26, and vice versa, in order to compensate for any misalignment between the drive shaft 14 and the inner propeller shaft 26 with one another while still transmitting torque therebetween. That is, while it is preferable that the drive shaft 14 and the inner propeller shaft 26 be generally axially aligned with one another during operation of the marine propulsion system 2, the mating spline connection 40 permits a small amount of deviation between the drive shaft 14 and the inner propeller shaft 26, and vice versa, without compromising the transfer of torque or the transfer of thrust between those two coupled shafts.

Downstream of the mating spline connection 40, the rotational drive power or the torque from the drive shaft 14, supplied by the engine 10 and the transmission 12, is transferred solely to the inner propeller shaft 26 and, thereafter, the path of drive power or torque flow is then eventually split along first and second flow paths. As discussed below in further detail, the rotational direction of second path of the torque will be, after passing through a planetary gear assembly 71, reversed so as to rotate in an opposite rotational direction from the first path thereof. Accordingly, the first and the second propellers 6, 8 will rotate in opposite rotational directions from one another and thereby provide a counter rotating drive for the marine propulsion system 2. In addition, if desired, the second path of the drive power or torque may be geared so as to rotate at a slightly faster rotational speed than the first flow of drive power or torque.

Figure 2:
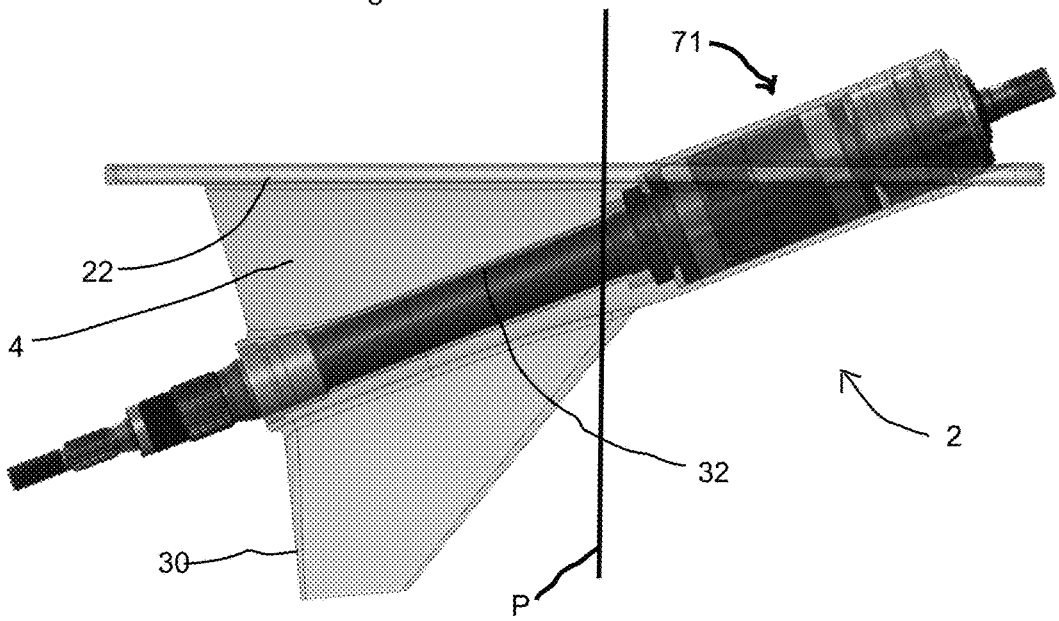
FIG. 2 is a diagrammatic perspective view showing the marine propulsion drive installed within a strut to form the marine propulsion system according to the disclosure, prior to installation on a vessel.

The inner propeller shaft 26 passes completely through the strut through bore 32 and extends out from the trailing end of the strut through bore 32 (see FIGS. 1 and 2). As shown in FIG. 3 for example, a first (aft) propeller 6 is securely, but removably, connected to a trailing end of the inner propeller shaft 26. Typically, the trailing end of the inner propeller shaft 26 has an exterior spine while an inwardly facing surface of the first (aft) propeller 6 has a mating internal spline (which together form a coupling feature). Once the internal spline of the first (aft) propeller 6 engages with the exterior spine of the inner propeller shaft 26, a first propeller nut 42 then threadedly engages with a threaded section, formed adjacent the trailing end of the inner propeller shaft 26, to releasably secure the first (aft) propeller 6 to the spline of the inner propeller shaft 26. The ability of the first propeller nut 42 to be released from the inner propeller shaft 26 also facilitates replacement of the first (aft) propeller 6 in the event the same becomes damaged, for some reason, during use. If desired, an inner shaft bushing or tapered collar may be located or formed on the inner propeller shaft 26, adjacent a trailing end of the outer propeller (quill) shaft 28, to prevent over insertion of the first (aft) propeller 6 on to the inner propeller shaft 26 and also possibly assist with transfer the thrust, generated by the first (aft) propeller 6, to the inner propeller shaft 26 and conveying the same upstream toward the strut 4 for distribution to the vessel. The first (aft) propeller 6 typically has a right handed pitch but, depending upon the rotational direction of the drive shaft 14, the first (aft) propeller 6 may alternatively have a left handed pitch.

Figure 4:
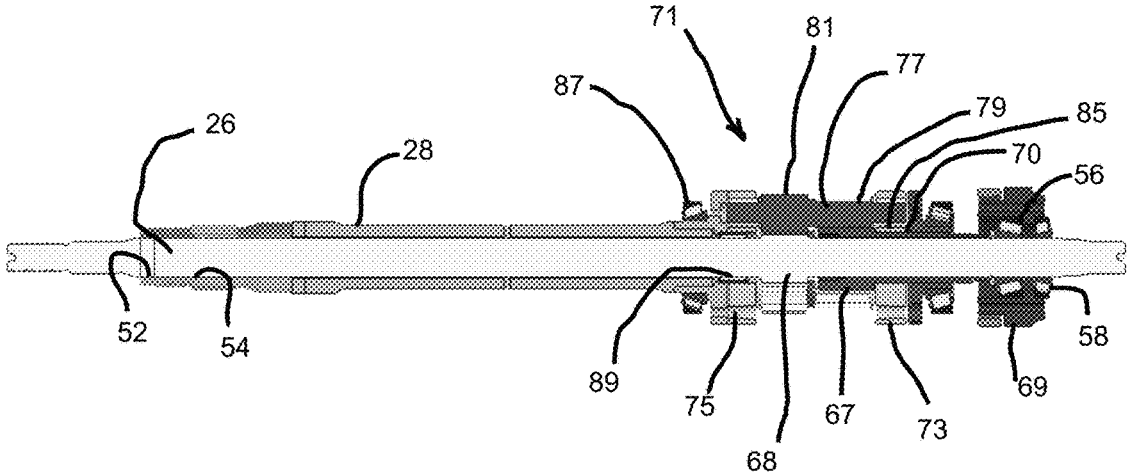
FIG. 4 is a diagrammatic cross section view of the marine propulsion drive of FIG. 3, along section line 4-4, prior to installation of the first and second counter rotating propellers on the marine propulsion drive.
Figure 7:
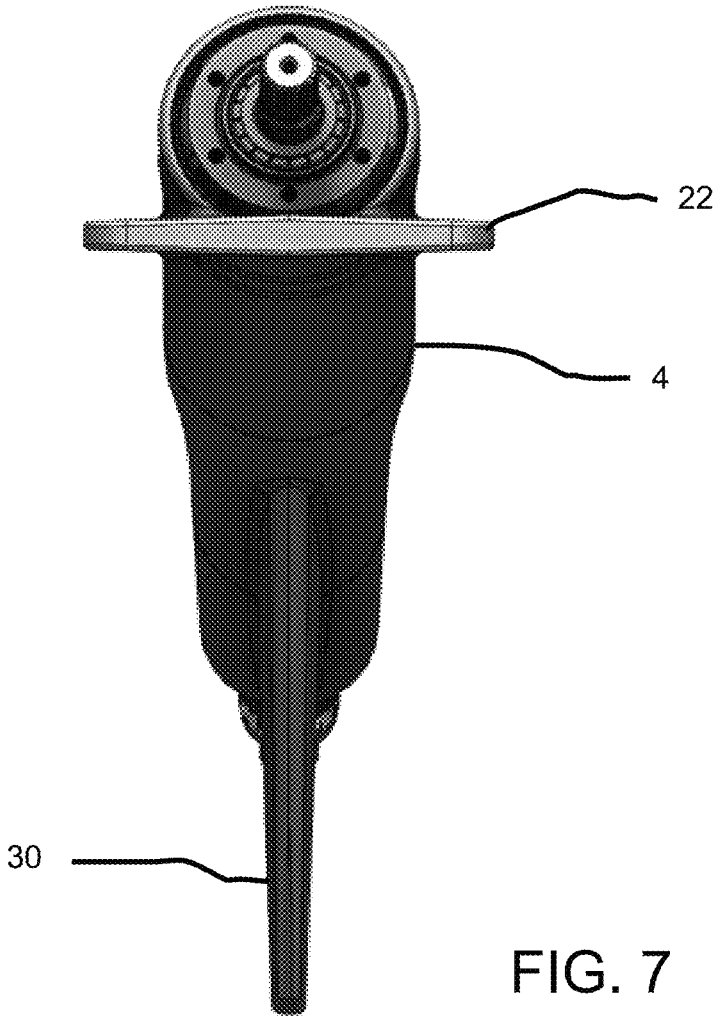
FIG. 7 is a diagrammatic front end view showing the streamlined hydrodynamic shape of the marine propulsion system according to the disclosure.

As best shown in FIG. 4 for example, the outer propeller (quill) shaft 28 surrounds the inner propeller shaft and the outer propeller (quill) shaft 28 has an axial length which is a somewhat shorter than the axial length of the inner propeller shaft 26, e.g., about half the length of the inner propeller shaft 26. As shown, the inner propeller shaft 26 projects a greater distance away from the trailing end of the strut 4 than the outer propeller (quill) shaft 28. Also as shown in FIG. 4, the inner propeller shaft 26 also projects away from the leading end of the strut 4 while the outer propeller (quill) shaft 28 does not projection out of the leading end of the strut 4. That is, a leading end of the outer propeller (quill) shaft 28 is spaced from the leading end of the strut through bore 32 by the planetary gear assembly 71. One or more radial lubricating port(s) (not shown in detail) may be formed within the outer propeller (quill) shaft 28, e.g., in a central section thereof, to facilitate the supply of lubricant through the outer propeller (quill) shaft 28 to the inner propeller shaft 26 and lubricate the same during operation of the marine propulsion system 2.

The leading end of the strut through bore 32 typically has a larger diameter than the trailing end of the strut through bore 32 and the strut through bore 32 reduces in size from the leading end toward the trailing end thereof, generally in the location where the skeg 30 commences—see FIG. 2. The reason for this is that the leading end of the strut through bore 32 and a portion of the interior of the vessel generally accommodates a portion of the planetary gear assembly 71, discussed below in further detail, which is larger in diameter than the combined outer and inner propeller shafts 28, 26, which project from the trailing end of the strut through bore 32. Since the larger diameter drive components are located toward the leading end of the strut 4 and at least partially accommodated within the vessel, this arrangement streamlines the overall exterior shape and size of the strut 4 to thereby minimize the strut size and reduce drag as the marine propulsion system 2 travels through water.

As shown in FIG. 2, approximately ½ of the rotatable planetary gear assembly 71 is located vertically above the flat end face 22 of the strut 4 and thus accommodated within the vessel while approximately ½ of the rotatable planetary gear assembly 71 is located vertically below the flat end face 22 of the strut 4. In addition, as also shown in FIG. 2, the entire planetary gear assembly 71 is generally located forward of a mid plane P of the flat end face 22 of the strut 4.

The second (forward) propeller 8 is securely, but removably, connected to a trailing end of the outer propeller (quill) shaft 28. Typically, the trailing end of the outer propeller (quill) shaft 28 has an exterior spine while the inwardly facing surface of the second (forward) propeller 8 has a mating spline (which together form a coupling feature). Once the spline of the second (forward) propeller 8 engages with the exterior spine of the outer propeller (quill) shaft 28, a second propeller nut 48 threadedly engages with a threaded section, formed at the trailing end of the outer propeller (quill) shaft 28, to releasably secure the second (forward) propeller 8 to the spline of the outer propeller (quill) shaft 28. The ability of the second propeller nut 48 to be released from the outer propeller (quill) shaft 28 also facilitates replacement of the second (forward) propeller 8 in the event the same becomes damaged, for some reason.

An outer shaft bushing may be provided on the outer propeller (quill) shaft 28, adjacent a trailing end of the strut through bore 32, to prevent over insertion of the second propeller 8 on the outer propeller (quill) shaft 28 and also transfer the thrust, generated by the second propeller 8, to the outer propeller (quill) shaft 28 and convey the same upstream toward the strut 4 and the mating spline connection 40 for distribution to the vessel. The second (forward) propeller 8 typically has a left handed pitch but, depending upon the rotational direction of the drive shaft 14, the second (forward) propeller 8 may possibly have a right handed pitch. It is to be noted that the second (forward) propeller 8 will be installed before the first (aft) propeller 6.

A conventional first rotatable fluid tight seal assembly 52 (only diagrammatically shown in FIG. 4) is located between the trailing end of the inner propeller shaft 26 and the trailing end of the outer propeller (quill) shaft 28 to prevent water from passing between the inner and the outer propeller shafts 26, 28. In addition, at least a first needle bearing 54 is located between the trailing end of the inner propeller shaft 26 and the trailing end of the outer propeller (quill) shaft 28, adjacent to but located upstream of the first rotatable fluid tight seal assembly 52, to facilitate rotation of the inner and the outer propeller shafts 26, 28, relative to one another, in opposite rotational directions.

A pair of conventional first and second tapered roller bearings 56, 58 (see FIGS. 4-6) are located between a housing assembly 69, which is fixedly secured to the strut 4, so as to permit rotation of the inner propeller shaft 26 relative to the housing assembly 69 and the strut 4. The respective inner races of the first and second tapered roller bearings 56, 58 directly engage with the inner propeller shaft 26 while the outer races of the first and second tapered roller bearings 56, 58 directly engage with the housing assembly 69.

A forward sun gear 67 is securely fastened to a downstream portion of the housing assembly 69 at a trailing end of a cylindrical hollow shaft 70 which has a spline connection, at an opposed end thereof, for example (not shown in detail), with the housing assembly 69 so as to prevent rotation of the forward sun gear 67. An aft sun gear 68 is formed integrally with the inner propeller shaft 26, adjacent to but located a small distance downstream of the forward sun gear 67. Planetary gears 79, 81 of the planetary gear assembly 71 respective engage with and surrounds both the forward sun gear 67 and the aft sun gear 68. The planetary gear assembly 71 further comprises a solid forward planetary hub 73, located between the forward sun gear 67 and the leading end of the inner propeller shaft 26, and a solid aft planetary hub 75, located between the aft sun gear 68 and the trailing end of the inner propeller shaft 26.

Each one of the forward and aft planetary hubs 73, 75 has an identical number of pinion through bores 65 formed therein, e.g., typically between two and ten pinion through bores 65 and generally about five pinion through bores 65. It is to be appreciated that the overall number of pinion through bores 65 may vary from application to application, without departing from the spirit and scope of the present disclosure. Each opposed end of a respective planetary pinion shaft 77 is rotatably supported, e.g., by a needle bearing 93, within an aligned pair of the pinion through bores 65 formed in the forward and aft planetary hubs 73, 75. The needle bearings 93 facilitate rotation of each one of the planetary pinion shafts 77 relative to the forward and aft planetary hubs 73, 75.

A double planetary gear is integrally formed on each one of the planetary pinion shafts 77. The integral double planetary gear comprises a slightly smaller diameter forward planetary gear 81, which engages with the fixed slightly larger diameter forward sun gear 67, while a slightly larger diameter aft planetary gear 79 engages with the rotatable slightly smaller diameter aft sun gear 68, which is formed integrally with the inner propeller shaft 26.

A forward hub tapered roller bearing 83 is located between the housing assembly 69 and the forward planetary hub 73 to facilitate rotation of a portion of the planetary gear assembly 71 relative to the housing assembly 69. In addition, a needle bearing 85 is provided between the inner propeller shaft 26 and the fixed forward sun gear 67 to facilitate relative rotation therebetween. An aft hub tapered roller bearing 87 is located between the aft planetary hub 75 and the strut 4 to facilitate rotation of the planetary gear assembly 71 relative to the strut 4 while maintaining the planetary gear assembly 71 generally centered within the strut through bore 32. In addition, a needle bearing 89 is provided between an aft portion of the planetary gear assembly 71 and the inner propeller shaft 26 to facilitate relative rotation therebetween.

The inner propeller shaft 26 supports a centering bearing 91 which assists with maintaining the rotatable planetary gear assembly 71 centered with respect to the inner propeller shaft 26 during operation. An inner race of the centering bearing engages with the inner propeller shaft 26 while an outer race of the centering bearing engages with the rotatable planetary gear assembly 71, e.g., a section of the planetary pinion shafts 77 located between the smaller diameter forward planetary gears 81 and the larger diameter aft planetary gears 79, so as to maintain those two components constantly centered with respect to one another.

As a result of the above arrangement, the planetary gear assembly 71 has a very compact arrangement which reverses the rotational direction of the supplied drive or torque. When rotational drive is supplied from the engine 10 along the drive shaft 14 to the inner propeller shaft 26, a first portion of the drive/torque, e.g., typically 30-50% or so, is transferred, via the first flow path, directly to the aft propeller 6 while a remaining second portion of the drive/torque, e.g., typically 70-50% or so depending upon the gear ratio of the planetary gear assembly 71 and the forward and aft sun gears 67, 68, is transferred to the forward propeller 8, via the second flow path.

As indicated above, the aft sun gear 68 is formed integral with the inner propeller shaft 26 and thus rotates at the same rotational speed and in the same rotational direction as the inner propeller shaft 26. If the inner propeller shaft 26 rotates in a counter clockwise rotational direction, then the aft sun gear 68 will also rotate in a counter clockwise rotational direction and at the same rotational speed. Such rotation of the aft sun gear 68 will, in turn, cause the engaged slightly larger diameter aft planetary gears 79 to rotate in a clockwise rotational direction. Since the slightly larger diameter aft planetary gears 79 are formed integrally with the slightly smaller diameter forward planetary gears 81, the slightly smaller diameter forward planetary gears 81 will also rotate in a clockwise rotational direction.

As noted above, the slightly smaller diameter forward planetary gears 81 directly engage with the external teeth of the forward sun gear 67 which are fixedly attached to the housing assembly 69. Such clockwise rotation of the slightly larger diameter aft planetary gears 79 and slightly smaller diameter forward planetary gears 81, in turn, causes an output of the entire planetary gear assembly 71 to rotate in a clockwise rotational direction relative to the housing 69. Since the outer propeller (quill) shaft 28 is securely attached to and integral with the output of the planetary gear assembly 71 by a plurality of conventional fasteners, the outer propeller (quill) shaft 28 and the supported forward propeller 8 will, in turn, both also rotate in a clockwise rotational direction while the inner propeller shaft 26 and the aft propeller 6 both rotate in a counter clockwise rotational direction.

During operation of the marine propulsion system 2, the thrust, generated by the first propeller 6, is conveyed upstream along the inner propeller shaft 26 to the drive shaft 14 and then to the flat end face 22 and the mounting plate 18 of the strut 4 for eventually dispersion and distribution throughout the vessel. In addition, the thrust, generated by the second propeller 8, is conveyed upstream along the outer propeller (quill) shaft 28 to the flat end face 22 and the mounting plate 18 of the strut 4 for eventually dispersion and distribution throughout the vessel. As a result of the disclosed arrangement, virtually all of the generated thrust, from both the first and the second propellers 6, 8, is transferred to the flat end face 22 and the mounting plate 18 of the strut 4 for dispersion and distribution throughout the vessel.

In order to facilitate lubrication of all of the various bearings, e.g., the planetary gear assembly 71, the needle bearings, the tapered bearings, the thrust bearings, the gear set, etc., the marine propulsion system 2 is provided with a closed lubrication system. For example, the mounting plate 18 may include a filling inlet which assists with adding lubricant to the marine propulsion system 2. A dip stick may be received within the filling inlet to normally close and seal the filling inlet. As is conventional in the art, the dip stick functions as a lubricant fluid level indicator for indicating to an operator, or service personnel, when the current level of the lubricant, contained within the lubricant system, is in need of replenishment, replacement or servicing.

While the various drive connections have been described as generally being mating spline connections, it is to be appreciated that any other conventional connection mechanism or coupling feature may instead be utilized for transferring torque or thrust, from one shaft/component to another shaft/component, without the departing from the spirit and scope of the present disclosure.

It is apparent that various modifications and alterations of the disclosed embodiment will occur to and be readily apparent to those skilled in the art. However, it is to be expressly understood that such modifications and alterations are within the scope and spirit of the present disclosure, as set forth in the appended claims. Further, the disclosure(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

It will be understood that various modifications may be made without departing from the scope of the disclosure. Although operations are depicted in the drawings a particular order, this should not be understood as requiring that such operations be performed in the particular order shown or in sequential order, or that all illustrated operations be performed, to achieve desirable results.

Wherefore, we claim:

1. A marine propulsion system, supported by a strut, comprising:

an inner propeller shaft supporting a first propeller adjacent a trailing end thereof, and the inner propeller shaft having an interface, at a leading end thereof, to facilitate connection with a drive shaft for receiving torque therefrom and supplying a first portion of the torque to the first propeller;

an outer propeller shaft supporting a second propeller, adjacent a trailing end thereof, and the outer propeller shaft surrounding the inner propeller shaft;

the strut having a strut through bore for accommodating and surrounding the inner and the outer propeller shafts, and the strut having a flat end face configured to abut an outwardly facing bottom surface of a hull of a vessel; and a planetary gear assembly for receiving a second portion of the torque from the drive shaft and supplying the second portion of torque to the outer propeller shaft so that the second propeller rotates in an opposite rotational direction than the first propeller;

wherein at least a portion of the planetary gear assembly is accommodated vertically above the flat end face of the strut for reducing hydrodynamic drag generated by the strut as the marine propulsion system travels through water.

2. The marine propulsion system according to claim 1, wherein the marine propulsion system is incorporated into the vessel which includes a transmission and an engine, the engine is drivingly connected to the transmission, and the transmission is drivingly connected to a leading end of the drive shaft to transfer generated torque thereto, and a rudder is located downstream of the first and second propellers to facilitate steering of the vessel by an operator.

3. The marine propulsion system according to claim 1, wherein an internal spline of the second propeller engages with an exterior spine of the outer propeller shaft and a second propeller nut threadedly engages with a threaded section, formed adjacent the trailing end of the outer propeller shaft, to releasably secure the second propeller to the spline of the outer propeller shaft, and an internal spline of the first propeller engages with an exterior spine of the inner propeller shaft and a first propeller nut threadedly engages with a threaded section, formed adjacent the trailing end of the inner propeller shaft, to releasably secure the first propeller to the spline of the inner propeller shaft.

4. The marine propulsion system according to claim 1, wherein the strut is fixedly secured to the bottom surface of the hull of the vessel by a mounting plate and a plurality of fasteners such that, following installation of the strut, a portion of the hull is sandwiched between the mounting plate and the flat end face of the strut.

5. The marine propulsion system according to claim 4, wherein at least one contoured spacer insert/shim is located between the bottom surface of the hull and the flat end face of the strut to modify an orientation/position of the strut, relative to at least one of the hull or the drive shaft, and assist with aligning the drive shaft with at least the inner and outer propeller shafts.

6. The marine propulsion system according to claim 1, wherein the strut through bore extends completely through the strut from a leading end to a trailing end thereof, and the strut through bore reduces in diameter from the leading end to the trailing end thereof for accommodating the rotatable drive components of the marine propulsion system therein.

7. The marine propulsion system according to claim 1, wherein an aft sun gear is formed integrally with the inner propeller shaft for driving the second propeller.

8. The marine propulsion system according to claim 7, wherein a forward sun gear is securely fastened to a housing assembly so as to prevent rotation of the forward sun gear during operation of the marine propulsion system.

9. The marine propulsion system according to claim 8, wherein the forward sun gear and the aft sun gear comprise components of a rotatable planetary gear assembly, the planetary gear assembly further comprises a forward planetary hub and an aft planetary hub and each of the forward and aft planetary hubs has an identical number of pinion through bores formed therein, and a first end of a respective planetary pinion shaft is supported by the forward planetary hub while a second respective end of each planetary pinion shaft is supported by the aft planetary hub.

10. A marine propulsion system, supported by a strut, comprising:

an inner propeller shaft supporting a first propeller adjacent a trailing end thereof, and the inner propeller shaft having an interface, at a leading end thereof, to facilitate connection with a drive shaft for receiving torque therefrom and supplying a first portion of the torque to the first propeller;

an outer propeller shaft supporting a second propeller, adjacent a trailing end thereof, and the outer propeller shaft surrounding the inner propeller shaft;

the strut having a strut through bore for accommodating and surrounding the inner and the outer propeller shafts, and the strut having a flat end face configured to abut an outwardly facing bottom surface of a hull of a vessel; and a planetary gear assembly for receiving a second portion of the torque from the drive shaft and supplying the second portion of torque to the outer propeller shaft so that the second propeller rotates in an opposite rotational direction than the first propeller;

wherein at least a portion of the planetary gear assembly is accommodated vertically above the flat end face of the strut for reducing hydrodynamic drag generated by the strut as the marine propulsion system travels through water;

an aft sun gear is formed integrally with the inner propeller shaft for driving the second propeller;

a forward sun gear is securely fastened to a housing assembly so as to prevent rotation of the forward sun gear during operation of the marine propulsion system;

the forward sun gear and the aft sun gear comprise components of a rotatable planetary gear assembly, the planetary gear assembly further comprises a forward planetary hub and an aft planetary hub and each of the forward and aft planetary hubs has an identical number of pinion through bores formed therein, and a first end of a respective planetary pinion shaft is supported by the forward planetary hub while a second respective end of each planetary pinion shaft is supported by the aft planetary hub; and wherein each the planetary pinion shaft supports an integrally formed double planetary gear, the integral double planetary gear comprises a slightly smaller diameter forward planetary gear, which engages with the forward sun gear and a slightly larger diameter aft planetary gear which engages with the aft sun gear.

11. The marine propulsion system according to claim 10, wherein a forward hub tapered roller bearing is located between the housing assembly and the forward planetary hub to facilitate rotation of the planetary gear assembly relative to the housing assembly, and an aft hub tapered roller bearing is located between the aft planetary hub and the strut to facilitate rotation of the planetary gear assembly relative to the strut.

12. The marine propulsion system according to claim 9, wherein the inner propeller shaft supports a centering bearing which assists with maintaining the rotatable planetary gear assembly centered with respect to the inner propeller shaft during operation.

13. The marine propulsion system according to claim 1, wherein a spline on a trailing end of the drive shaft matingly engages with a spline at a leading end of the inner propeller shaft to form the interface which couples the drive shaft and the inner propeller shaft with one another while also compensating for misalignment between the drive shaft and the inner propeller shaft.

14. The marine propulsion system according to claim 1, wherein a rotatable fluid tight seal assembly is located between the trailing end of the inner propeller shaft and the trailing end of the outer propeller shaft to prevent water from passing between the inner and the outer propeller shafts; and a needle bearing is located between the trailing end of the inner propeller shaft and the trailing end of the outer propeller shaft, adjacent to but upstream of the rotatable fluid tight seal assembly, to facilitate rotation of the inner and the outer propeller shafts relative to one another.

15. The marine propulsion system according to claim 14, wherein between 30-50% of the torque is transferred, via a first flow path, to the aft propeller while a remaining 70-50% of the torque is transferred to the forward propeller, via a second flow path.

16. The marine propulsion system according to claim 3, wherein approximately ½ of the rotatable planetary gear assembly is located vertically above the flat end face of the strut and approximately ½ of the rotatable planetary gear assembly is located vertically below the flat end face of the strut.

17. The marine propulsion system according to claim 11, wherein the planetary gear assembly is located forward of a mid plane of the flat end face of the strut.

18. The marine propulsion system according to claim 1, wherein the marine propulsion system is incorporated into the vessel which includes a transmission and an engine, the engine is drivingly connected to the transmission, and the transmission is drivingly connected to a leading end of the drive shaft to transfer generated torque thereto, and a rudder is located downstream of the first and second propellers to facilitate steering of the vessel by an operator.

19. The marine propulsion system according to claim 1, wherein between 30-50% of generated torque is transferred to the aft propeller while a remaining 70-50% of the generated torque is transferred to the forward propeller.

20. A method of using a marine propulsion system to power a vessel, the method comprising:

supporting the marine propulsion system on the vessel by a strut;

supporting a first propeller adjacent a trailing end of an inner propeller shaft;

providing an interface at a leading end of the inner propeller shaft to facilitate connection with a drive shaft for receiving torque therefrom and supplying a first portion of the torque to the first propeller;

supporting a second propeller adjacent a trailing of an outer propeller shaft, and the outer propeller shaft surrounding the inner propeller shaft;

providing the strut with a flat end face that abuts an outwardly facing bottom surface of a hull of the vessel, and providing the strut with a strut through bore for accommodating and surrounding the inner and the outer propeller shafts; and providing a planetary gear assembly for receiving a second portion of the torque from the drive shaft and supplying the second portion of torque to the outer propeller shaft so that the second propeller rotates in an opposite rotational direction to the first propeller; and accommodating at least a portion of the planetary gear assembly vertically above the flat end face of the strut so as to reduce hydrodynamic drag, generated by the strut, as the marine propulsion system travels through water.

* * * * *